US010086983B2

(12) United States Patent
Schultz et al.

(10) Patent No.: US 10,086,983 B2
(45) **Date of Patent: *Oct. 2, 2018**

(54) CLOSED LOOP CONNECTOR FOR DISPENSING SYSTEMS

(71) Applicant: Ecolab USA Inc., St. Paul, MN (US)

(72) Inventors: Jeffrey Michael Schultz, Hudson, WI (US); Thaddeus Feiler, South St. Paul, MN (US); Erika Theresa Erlandson, Edina, MN (US); Peter Swenson, Cannon Falls, MN (US); Lisa A. Kreye, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/096,863

(22) Filed: Apr. 12, 2016

(65) Prior Publication Data

US 2016/0244221 A1 Aug. 25, 2016

Related U.S. Application Data

(63) Continuation of application No. PCT/US2016/019053, filed on Feb. 23, 2016, which (Continued)

(51) Int. Cl.

| | |
|---|---|
| ***B67D 3/00*** | (2006.01) |
| ***B65D 47/32*** | (2006.01) |
| ***B67D 7/02*** | (2010.01) |

(52) U.S. Cl.
CPC ..... *B65D 47/32* (2013.01); *B67D 7/0294* (2013.01)

(58) Field of Classification Search
CPC ..... B65D 47/23; B65D 47/245; B65D 47/30; B65D 47/121; B65D 47/2068; B67D 7/0294

(Continued)

(56) References Cited

U.S. PATENT DOCUMENTS 4,411,287 A 10/1983 Hyde
4,445,539 A 5/1984 Credle
(Continued)

FOREIGN PATENT DOCUMENTS

EP 657005 A1 6/1995
EP 657005 B1 6/1995
(Continued)

OTHER PUBLICATIONS

International Search Report and Written Opinion for International Application No. PCT/US2016/019053, dated Jun. 19, 2016; 15 pages.

*Primary Examiner* — Lien Ngo
(74) *Attorney, Agent, or Firm* — Fredrikson & Byron, P.A.

(57) ABSTRACT

A closed loop dispensing system comprises a connector connectable to a container for selectively dispensing the fluids from the container. The connector includes an outer cap having a first passage with an interior surface. The first passage can have variable cross-sectional areas over different regions of the first passage. The connector comprises a plug slidingly movable between an open position and a closed position, wherein, the plug allows passage of fluids present in the container in the open position, and the plug prevents passage of fluids out of the container in the closed position. The plug can have a variable cross-sectional area thereby preventing the plug from being disengaged with the outer cap or sliding out of the connector and into the container.

27 Claims, 12 Drawing Sheets

Related U.S. Application Data is a continuation-in-part of application No. 14/628,572, filed on Feb. 23, 2015, now Pat. No. 9,469,452.

(58) Field of Classification Search

USPC ..... 222/546, 547, 549, 556, 561, 522, 526, 222/531; 137/212, 123, 124, 150.5, 151, 137/152, 614.05, 614.06, 798

See application file for complete search history.

(56) References Cited

U.S. PATENT DOCUMENTS

| | | | | |
|---|---|---|---|---|
| 4,934,655 | A | 6/1990 | Blenkush et al. | |
| 5,046,645 | A | 9/1991 | Hagan et al. | |
| 5,165,578 | A | 11/1992 | Laible | |
| 5,178,295 | A | 1/1993 | Crumrine et al. | |
| 5,178,303 | A | 1/1993 | Blenkush et al. | |
| 5,203,477 | A * | 4/1993 | Lo | B67D 1/0832 137/212 |
| 5,353,836 | A | 10/1994 | Decler et al. | |
| 5,639,064 | A | 6/1997 | Decler et al. | |
| 5,890,517 | A | 4/1999 | Laible | |
| 5,911,403 | A | 6/1999 | Decler et al. | |
| 5,975,489 | A | 11/1999 | Decler et al. | |
| 5,988,456 | A | 11/1999 | Laible | |
| 6,142,345 | A | 11/2000 | Laible | |
| 6,213,353 | B1 | 4/2001 | Haul et al. | |
| 6,354,473 | B1 | 3/2002 | Brambach et al. | |
| 6,382,593 | B1 | 5/2002 | deCler et al. | |
| 6,607,174 | B2 | 8/2003 | Weber et al. | |
| 6,626,419 | B2 | 9/2003 | deCler et al. | |
| 6,644,519 | B2 | 11/2003 | Last | |
| 6,669,062 | B1 | 12/2003 | Laible | |
| 6,916,007 | B2 | 7/2005 | deCler et al. | |
| 6,923,345 | B1 | 8/2005 | Laible | |
| 6,945,432 | B2 | 9/2005 | Laible | |
| 6,945,433 | B2 | 9/2005 | Laible | |
| 6,968,983 | B2 | 11/2005 | Laible | |
| 6,978,800 | B2 | 12/2005 | deCler et al. | |
| 6,986,443 | B2 | 1/2006 | Laible | |
| 7,121,437 | B2 | 10/2006 | Kasting | |
| 7,546,857 | B2 | 6/2009 | Chadbourne et al. | |
| 7,631,783 | B1 | 12/2009 | Laible | |
| 7,832,599 | B2 | 11/2010 | Laible | |
| 7,841,492 | B2 | 11/2010 | Laible | |
| 7,854,354 | B2 | 12/2010 | Laible | |
| 8,066,157 | B2 | 11/2011 | Laible | |
| 8,083,107 | B2 | 12/2011 | Laible | |
| 8,191,735 | B2 | 6/2012 | Laible | |
| 8,220,665 | B2 | 7/2012 | Laible | |
| 8,684,026 | B2 * | 4/2014 | Rundin | B67D 1/0832 137/212 |
| 2002/0014608 | A1 | 2/2002 | deCler et al. | |
| 2002/0092867 | A1 | 7/2002 | Last | |
| 2003/0062498 | A1 | 4/2003 | DeCler et al. | |
| 2003/0071234 | A1 | 4/2003 | Weber et al. | |
| 2003/0196703 | A1 | 10/2003 | DeCler et al. | |
| 2005/0101939 | A1 | 5/2005 | Mitchell | |
| 2005/0247371 | A1 | 11/2005 | Chadbourne et al. | |
| 2006/0096932 | A1 | 5/2006 | Dema et al. | |
| 2008/0011785 | A1 | 1/2008 | Braun et al. | |
| 2009/0090690 | A1 | 4/2009 | Walton et al. | |
| 2012/0104029 | A1 | 5/2012 | Haas et al. | |
| 2012/0255973 | A1 | 10/2012 | Schlueter et al. | |
| 2012/0261441 | A1 | 10/2012 | van den Hoonaard | |
| 2013/0199662 | A1 | 8/2013 | Gebbink et al. | |

FOREIGN PATENT DOCUMENTS

| | | | |
|---|---|---|---|
| EP | 682641 | A1 | 11/1995 |
| EP | 892759 | A1 | 1/1999 |
| EP | 1175349 | A1 | 1/2002 |
| EP | 892759 | B1 | 2/2002 |
| EP | 1299664 | A1 | 4/2003 |
| EP | 910764 | B1 | 6/2004 |
| EP | 1175349 | B1 | 10/2006 |
| EP | 1299664 | B1 | 1/2007 |
| EP | 1747167 | A2 | 1/2007 |
| EP | 1185816 | B1 | 4/2008 |
| EP | 2051928 | A2 | 4/2009 |
| EP | 2508268 | A1 | 10/2012 |
| WO | 1990010815 | A1 | 9/1990 |
| WO | 1992020616 | A1 | 11/1992 |
| WO | 1994004859 | A1 | 3/1994 |
| WO | 1997038936 | A1 | 10/1997 |
| WO | 2000066448 | A1 | 11/2000 |
| WO | 2001027020 | A1 | 4/2001 |
| WO | 2001066458 | A2 | 9/2001 |
| WO | 200206711 | A1 | 1/2002 |
| WO | 2003089822 | A1 | 10/2003 |
| WO | 2005108280 | A2 | 11/2005 |
| WO | 2006054889 | A1 | 5/2006 |
| WO | 2008008392 | A2 | 1/2008 |
| WO | 2008008392 | A3 | 1/2008 |
| WO | 2009116850 | A1 | 9/2009 |
| WO | 2011074953 | A2 | 6/2011 |
| WO | 2011074953 | A3 | 6/2011 |
| WO | 2011096811 | A1 | 8/2011 |
| WO | 2011099854 | A1 | 8/2011 |
| WO | WO 2011/100937 | A1 * | 8/2011 |
| WO | 2012033405 | A1 | 3/2012 |
| WO | 2012044166 | A1 | 4/2012 |

* cited by examiner

CLOSED LOOP CONNECTOR FOR DISPENSING SYSTEMS

RELATED APPLICATION

This application is a Continuation of International Application No. PCT/US16/19053, filed Feb. 23, 2016, which is a continuation-in-part of U.S. application Ser. No. 14/628,572, filed Feb. 23, 2015, the disclosures of each are hereby incorporated by reference in their entirety.

FIELD

This disclosure generally relates to systems and methods for dispensing systems, and more particularly to packaging connectors for dispensing systems.

BACKGROUND

Dispensing systems are often used for dispensing fluids such as cleaning solutions (e.g., detergent, disinfectant, sanitizers, etc.), medical products (e.g., fluids administered intravenously during a medical procedure) and the like from a container (e.g., a bottle) with a connector. The connector may be connected to tubing and allow for passage of fluid stored in the container during use of the dispensing system. A dispensing probe, a hand pump and/or a nozzle can be connected to the connector for dispensing a quantity of chemical fluid (e.g., hand sanitizer). Such dispensing systems may be closed loop dispensing systems, wherein the dispensing system prevents a user from being exposed to the fluid contained in the container when the user is removing the lid or cap of the container to clean and/or dispose the container or refill fluids therein. Closed loop dispensing systems offer improved compliance to chemical safety guidelines and promote ease of use, disposal and refilling chemical products such as cleaning solutions. Such closed loop systems can often be shaped and sized to suit a variety of operations. For instance, dispensing systems can be generally rigidly shaped as bottles made of hard plastic (such as high or low density polyethylene), or can be generally flexibly shaped such as bags (e.g., "bag-and-box" dispensing system) made of polymeric materials flexible relative to the rigidly shaped bottle. In addition, the containers may be positioned upright or inverted to enhance ease of fluid delivery in a variety of operations. The dispensing systems may also include a vent (e.g., an opening on a bottle cap) to allow trapped air or other gases to escape from the container during storage or shipment of the chemical fluid.

The connectors of closed loop systems can dispense a predetermined dosage of the fluid. Such systems may include a spring-loaded valve for dispensing the predetermined dosage of chemical fluid out of the container. The connectors are typically sized and shaped according to the specific type of container in use. For instance, a connector intended to be used with a rigid bottle may not be interchangeably used with those for a flexible bag, and a connector intended for an inverted container may not be suitable for an upright container. Lack of a universal design for connectors may result in logistical difficulties when a user attempts to switch from one type of container (e.g., upright container) to a different type of container (e.g., inverted container) to allow for more effective dispensing. Connectors that include metal springs and valves also are not environmentally safe because such components may not be recycled. For example, a user may not be able to disengage the dispensing system to separate the recyclable components of the dispensing system from the non-recyclable components, ultimately not recycling the dispensing system at all. Additionally, the user may not follow safety procedures during filling, using, storing, and disposing chemicals (e.g., corrosive chemicals such as disinfectants) due to the complexity involved in assembling and disassembling dispensing systems that include a number of different components.

SUMMARY

Certain embodiments include a closed loop dispensing system, comprising a container comprising fluids dispensable out of the container. The system includes a connector for selectively dispensing the fluids from the container. The connector comprises an outer cap connected to the container opening. The outer cap can have a first passage having an interior surface. The first passage can have variable cross-sectional areas over varying regions of the first passage. The connector comprises a plug slidingly movable between an open position and a closed position, wherein, the plug allows passage of fluids present in the container in the open position, and the plug prevents passage of fluids out of the container in the closed position. A portion of the plug can have a cross-sectional area less than the cross-sectional area of a portion of the first passage such that the plug is prevented from sliding out of the first passage and thereby prevented from being disengaged with the outer cap. Moreover when the plug is in the open position, the plug is prevented sliding out of the connector and into the container.

In some embodiments, the connector comprises a plurality of crown elements positioned at a first surface of the plug. The crown elements flare radially outwardly from a longitudinal axis of the first passage to lock the plug proximal to the first end of the first passage in the closed position. The crown elements are retractable radially inwardly toward the longitudinal axis of the first passage to unlock the plug into the open position and allowing the plug to slide into the first passage along the longitudinal axis. The plug sliding from the first end of the first passage and into the first passage when the crown elements are in a retracted position.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
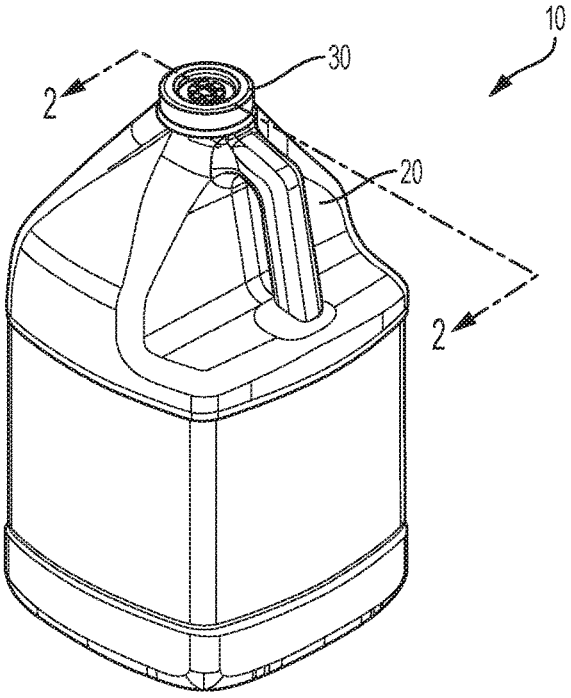
FIG. 1 is a perspective view of a container having a closed loop connector according to certain embodiments.
Figure 2:
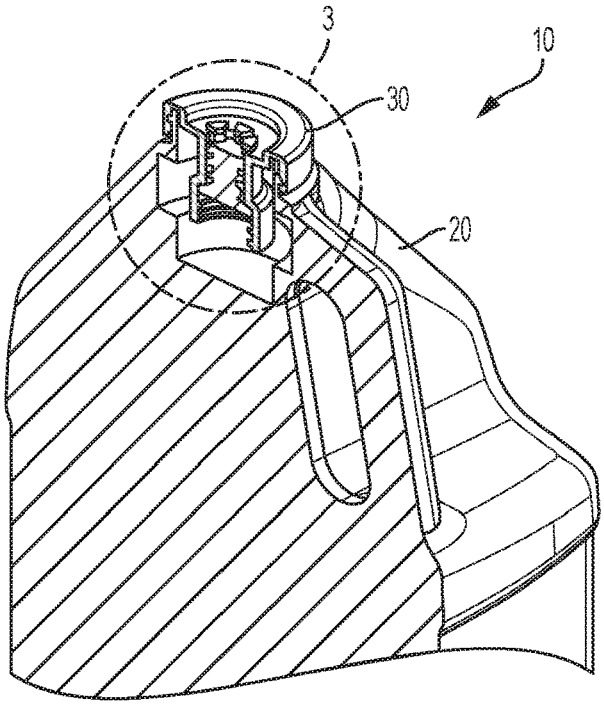
FIG. 2 is a sectional perspective view of the container of FIG. 1 taken along line 2-2.
Figure 3A:
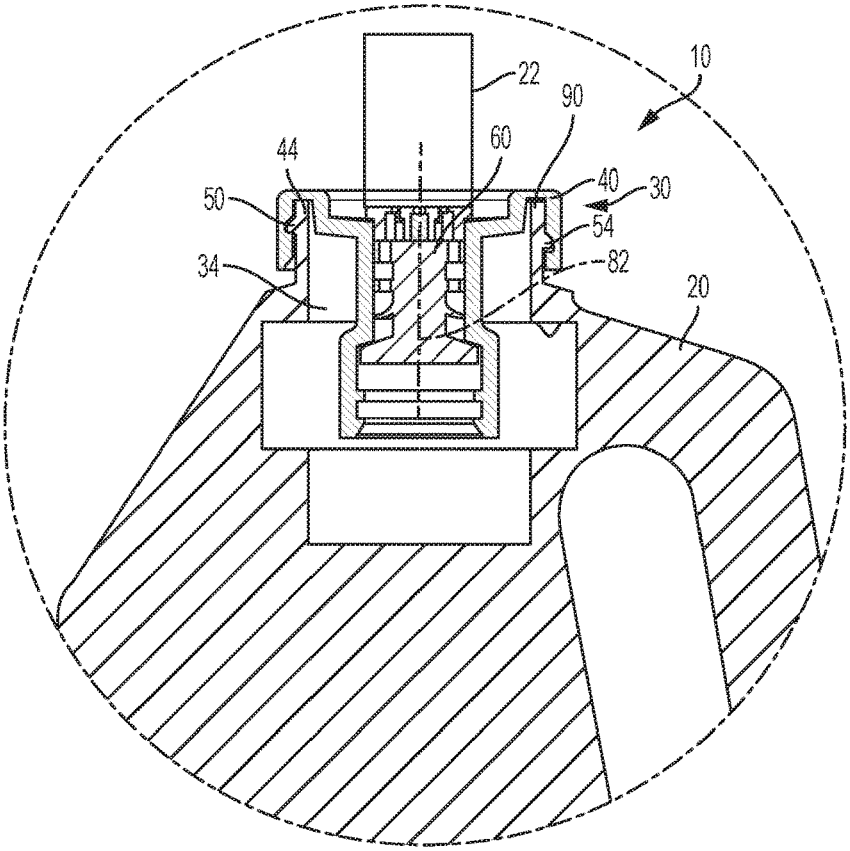
FIG. 3A is a close-up front view of the portion of FIG. 2 shown in a dotted line circle.
Figure 3B:
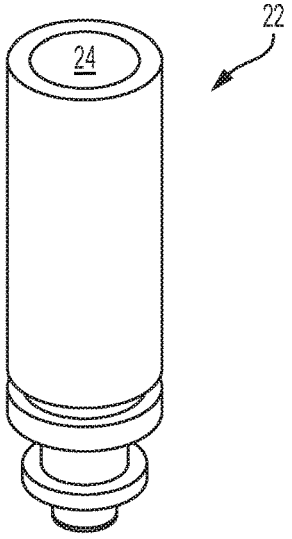
FIG. 3B is a perspective view of a dispensing probe according to an embodiment.

FIGS. 1-3B illustrate a dispensing system 10 according to some embodiments. The dispensing system 10 comprises a container 20 for storing fluids and a closed loop connector 30 for selectively dispensing fluids out of the container 20. As described previously, such containers can store fluids such as cleaning solution, disinfectant, sanitizer, and/or medical fluids while the container 20 is shown in an upright orientation. Other orientations (e.g., inverted with respect to the orientation in FIG. 1, laterally sideways with respect to the orientation in FIG. 1) are also contemplated. The closed loop connector 30 can prevent a user from inadvertently contacting the fluid when the user disposes, cleans or refills fluids. The connector therefore can be closed or opened to selectively dispense fluids from the container 20. As seen in FIG. 1, the container 20 can be a bottle. Alternatively, the container 20 can be a bag, box, or other known containers. The connector can selectively dispense fluid form the fluid container 20 via a dispensing probe 22 (e.g., a tube with a flow control device, such as check valves generally attached thereon) The dispensing probe 22 is best illustrated in FIG. 3B and can have a venturi-shaped passageway 24, wherein fluids can be drawn due to suction being generated in the venturi-shaped passageway. Alternatively, fluids can be dispensed by other methods known in the art (e.g., pumping, pouring and the like). The dispensing system 10 can also include a dosing element (e.g., flow meter) to control flow rate of fluids.

With continued reference to FIGS. 2 and 3A, the connector comprises a container opening 34. Fluids can be dispensed out of the connector via the container opening 34. The connector comprises an outer cap 40 supported on the container opening 34. The connector can be positioned to sit against an interior surface 170 of the connector opening. As seen in FIG. 3A, an outer surface 44 of the container opening 34 comprises ribs 50. The outer cap 40 can have mating ribs 50 on an inner surface 54 thereon. In such cases, the container opening 34 and outer cap 40 can be matingly connected with each other via the ribs 50 on the container opening 34 and the outer cap 40 to form a leak-free engagement. Alternatively, the container opening 34 can engage with the outer cap 40 via a threaded connection, a welded connection (e.g., plastic weld) or a friction fit with an interior surface 170 of the container 20 and sealed to prevent fluids in the container 20 from leaking (e.g., when the container 20 is tipped or inverted). For instance, the outer cap 40 can be pushed or snapped against the container opening 34. The cap can be made of plastic (e.g., higher density polyethylene). Other recyclables and/or biocompatible materials are also contemplated. The cap 40 also has a vent 58 as will be described further below.

Figure 4A:
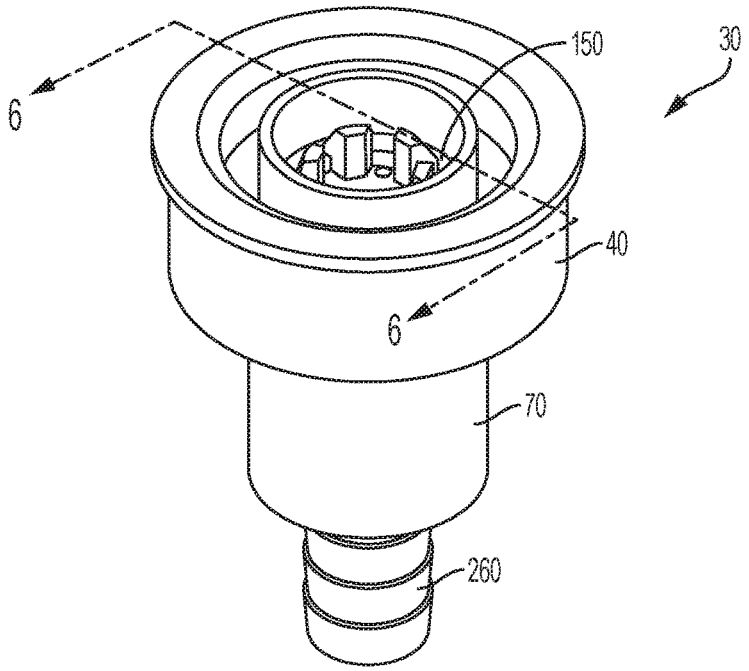
FIG. 4A is a perspective view of a closed loop connector according to a first embodiment.
Figure 4B:
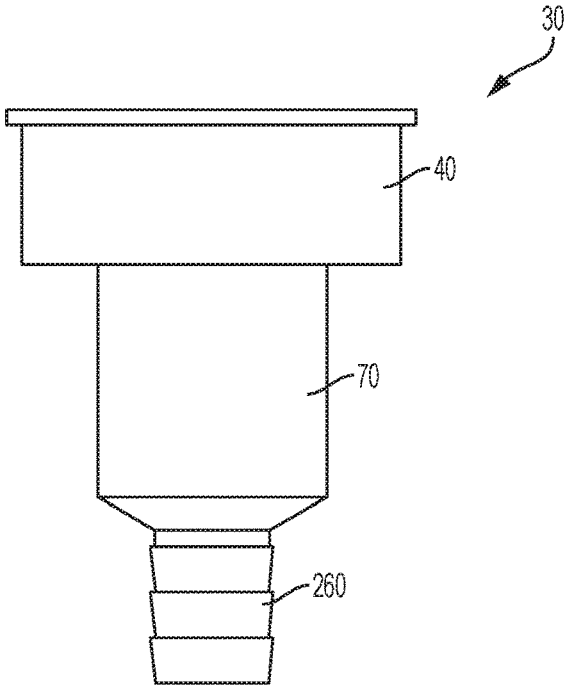
FIG. 4B is a front view of the closed loop connector of FIG. 4A.
Figure 5:
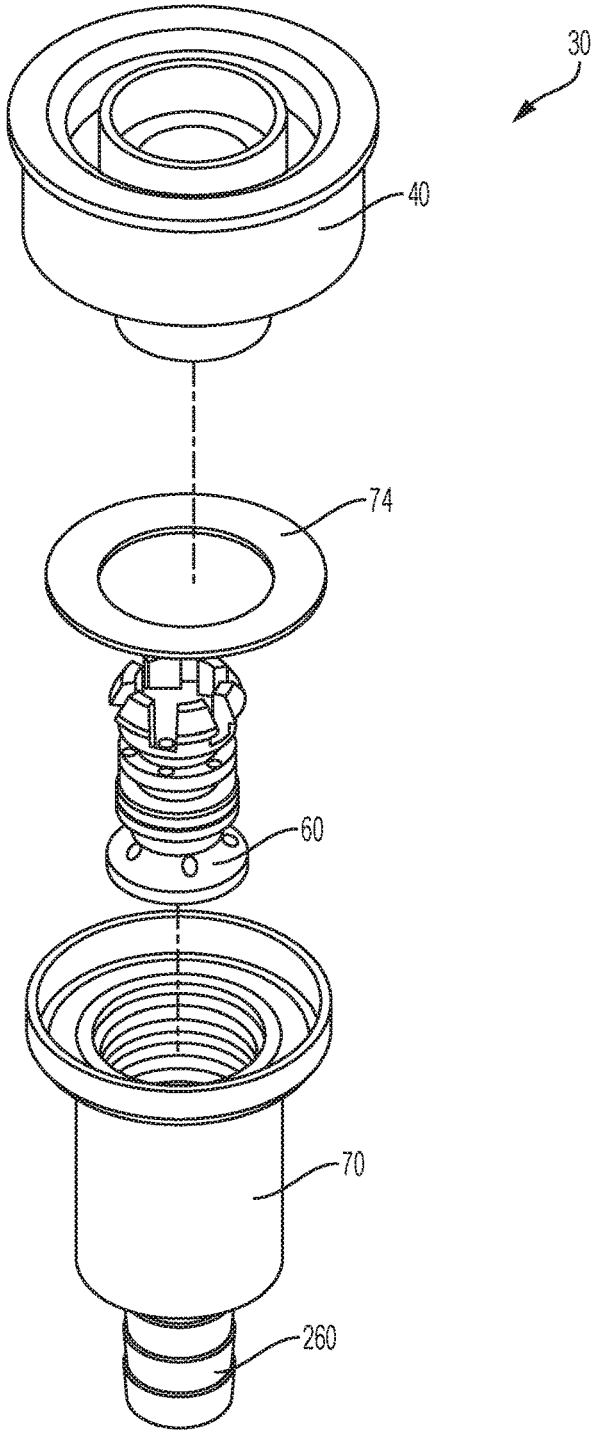
FIG. 5 is an exploded perspective view of the closed loop connector of FIG. 4A.

FIGS. 4A and 4B show perspective and front views of a connector according to one embodiment. The connector comprises a plug 60 engaging with the outer cap 40. The plug 60 can be moved between a closed position and an open position. In the closed position, the plug 60 prevents passage of fluids from inside the container 20 (not shown in FIGS. 4A and 4B), and in the open position, the plug 60 allows fluids to leave the container 20 via the connector and toward a dispensing probe. With continued reference to FIGS. 4A and 4B, the connector comprises a tube 70 connected to the outer cap 40 and housing the plug 60. The tube 70 can be placed inside the container 20 and/or can connect to a hose positioned inside the container 20. As seen in FIG. 5, in some cases, a gasket 74 can be positioned between the outer cap 40 and the tube 70. The gasket 74 can seal the gaps between the outer cap 40 and the tube 70, thereby preventing any leaks. The gasket 74 can be made of materials generally known for sealing gaps to prevent fluid leaks (e.g., O-rings).

Figure 6:
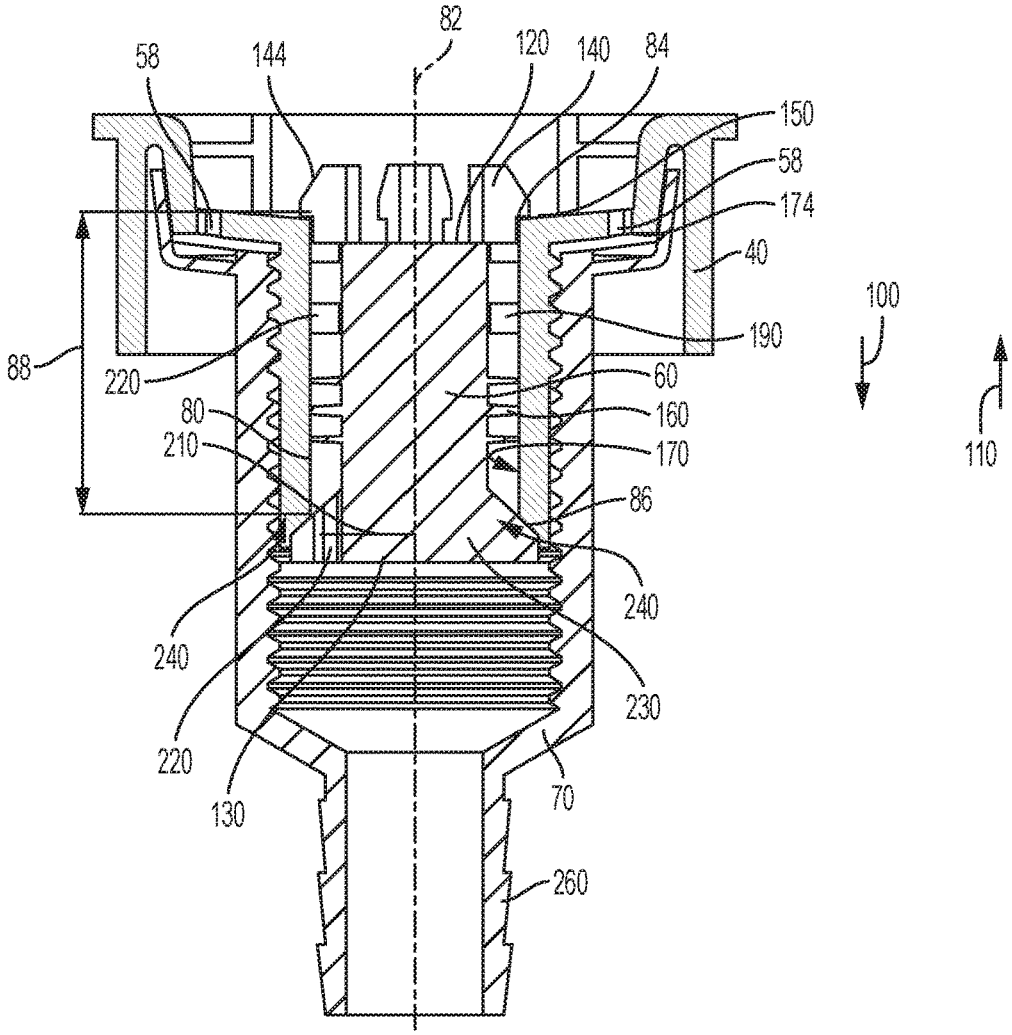
FIG. 6 is a sectional front view of the closed loop connector of FIG. 4A taken along plane 6-6.

Referring now to FIG. 6, the outer cap 40 has a first passage 80. The first passage 80 has a longitudinal axis 82, a first end 84, and a second end 86. The longitudinal axis 82 is defined such that the outer cap 40, the plug 60 and the tube 70 are positioned coaxially about the longitudinal axis 82. As shown in FIG. 6, the first and second ends are separated by a length 88 along the longitudinal axis 82. Referring back to FIG. 3A, the first end 84 of the first passage 80 is proximal to a top end 90 of the container opening 34 when the container 20 is in an upright position. Referring again to FIG. 6, the plug 60 can slidingly engage with the first passage 80. The plug 60 can be moved in the first passage 80 in a sliding fashion by the dispensing probe (not shown). For instance, when the dispensing probe is lowered toward the outer cap 40, the plug 60 can be unlocked from the closed position and slide along a first direction 100 into the first passage 80 away from the first end 84 of the first passage 80. When the dispensing probe is removed from the outer cap 40, the plug 60 can slide out of the first passage 80 along a second direction 110 and toward the first end 84 of the first passage 80. In some cases, the plug 60 can be locked into place when the dispensing probe is removed from the outer cap 40. The plug 60 can have a first surface 120 and a second surface 130. In the closed position, the first surface 120 of the plug 60 is proximal to the first end 84 of the first passage 80, and the plug 60 prevents any fluid from flowing out of the container 20. The plug 60 can be slid from the first end 84 of the first passage 80 and toward the second end 86 of the first passage 80 along the longitudinal axis 82. As the plug 60 slides further into the first passage 80 and away from the first end 84 of the first passage 80 along the first direction 100, the plug 60 permits fluid to flow out of the container 20, as will be explained below.

With continued reference to FIG. 6, the connector comprises a plurality of crown elements 140 positioned at the first surface 120 of the plug 60. The crown elements 140 flare radially outwardly from the longitudinal axis 82 of the first passage 80 to lock the plug 60 proximal to the first end 84 of the first passage 80 in its closed position. When locked, the plug 60 is prevented from sliding into the first passage 80 and moving away from the first end 84 of the first passage 80. The crown elements 140 retract radially inwardly toward the longitudinal axis 82 of the first passage 80 to unlock the plug 60 and allow the plug 60 to slide into the first passage 80 along the longitudinal axis 82 away from the first end 84 of the first passage 80. As described above, the plug 60 can be locked and unlocked from its closed position by disengaging or engaging the dispensing probe, respectively, and/or due to differences in pressure acting on the first end 84 and the second surface 130 of the plug 60. In such cases, the crown elements 140 are extended radially outwardly or retracted radially inwardly when the dispensing probe is engaged or disengaged respectively with the crown elements 140. For instance, when a vacuum is applied on the first surface 120 of the plug 60 (e.g., by engaging a dispensing probe having a vacuum therein, or by a vacuum pump), the pressure acting on the first surface 120 may be less than pressure acting on the second surface 130. The pressure acting on the second surface 130, for instance, can be equal to or greater than atmospheric pressure if the container 20 and/or fluid are pressurized. The pressure difference can therefore pull the plug 60 into the first passage 80 along the first direction 100 by retracting the crown elements 140. The plug 60 is unlocked and fluids are allowed to flow out of the container 20. Once dispensing is complete, the plug 60 can be locked by removing the dispensing probe, as a result of which, the pressures acting on the first and second surfaces of the plug 60 may be equal or the pressure on the second surface 130 can be greater than the pressure on the first surface 120 if the fluid in the container 20 is pressurized, which can result in the plug 60 moving toward the first end 84 of the first passage 80 along the second direction 110. The crown elements 140 can then extend radially outwardly to lock the plug 60 once dispensing is complete. Preferably, a vent 58 can be positioned on the outer cap 40 to provide off-gasing. As seen in FIG. 6, the vent 58 is annular in shape, and extends around the outer cap 40 such that the vent 58 is coaxial with the longitudinal axis 82.

Figure 7:
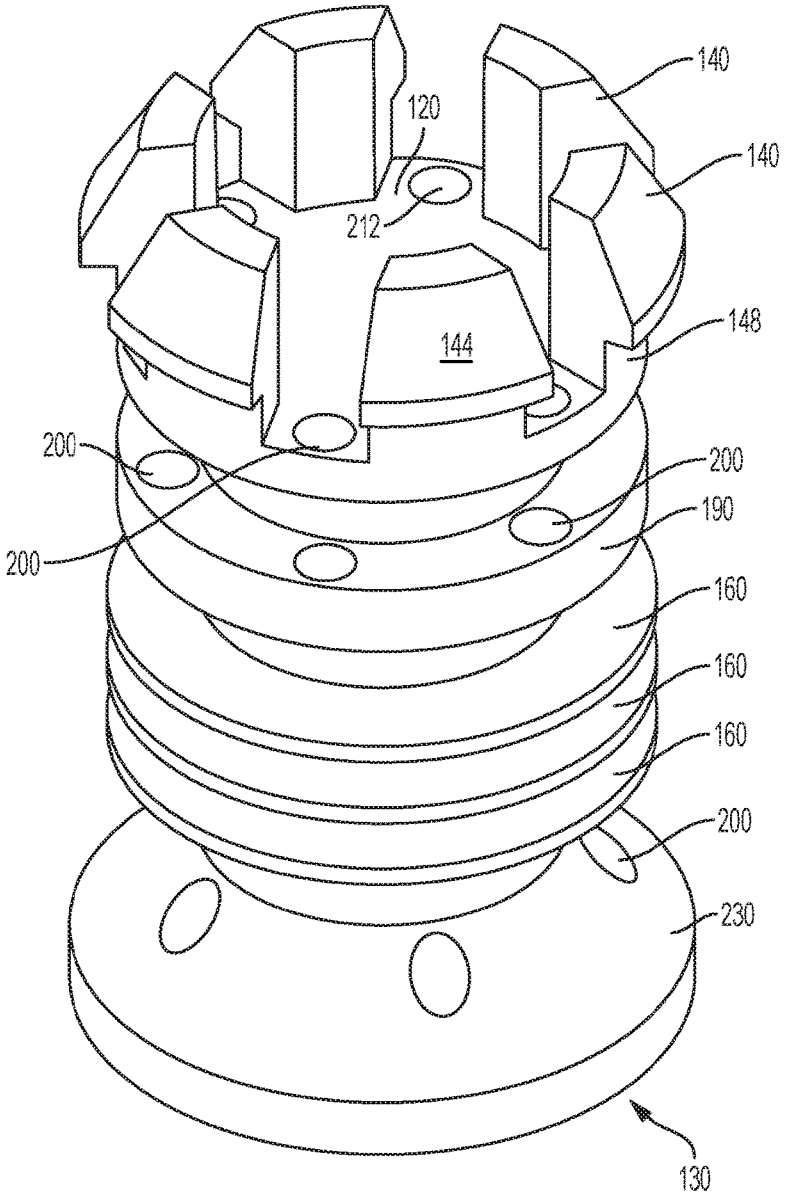
FIG. 7 is a perspective view of a plug shown in FIG. 4A according to certain embodiments.
Figure 8:
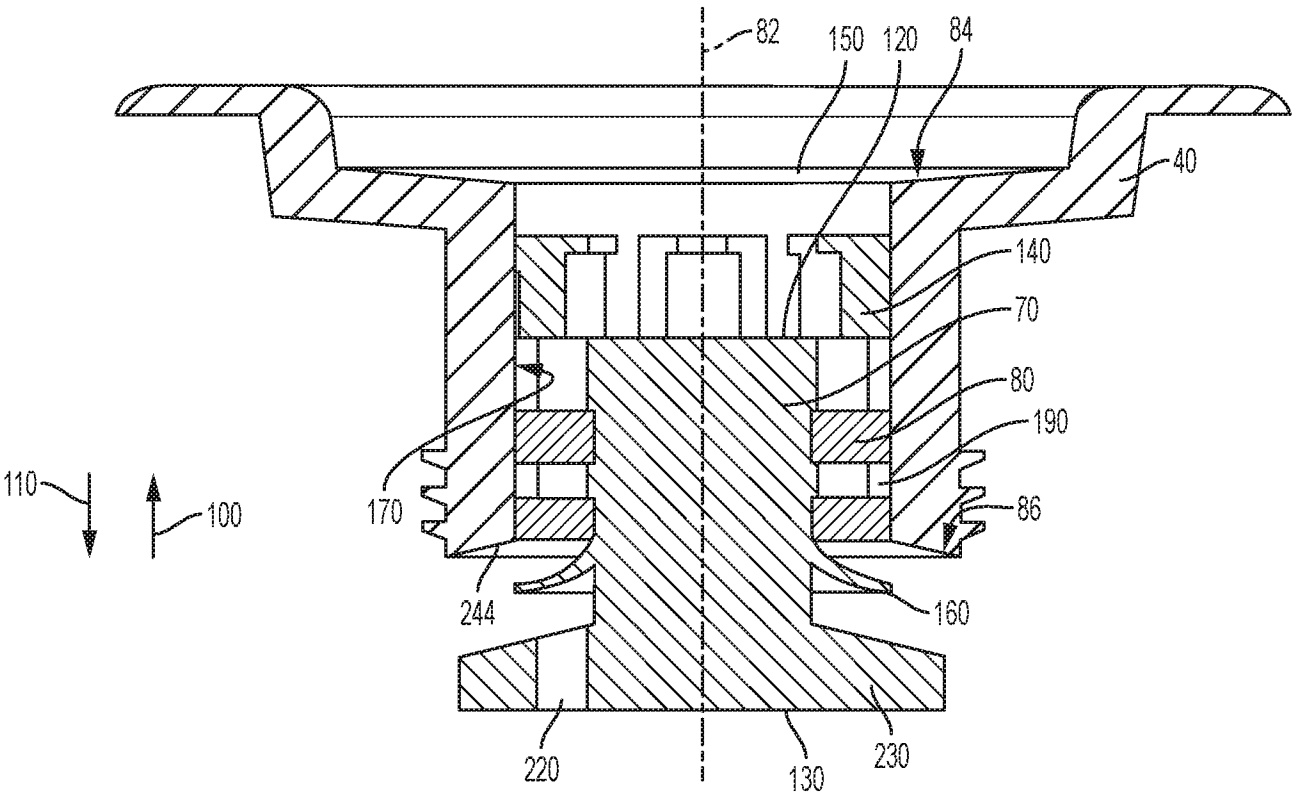
FIG. 8 is a sectional view of a closed loop connector according to a second embodiment shown with the plug in an open position, shown without a hollow tube.
Figure 9:
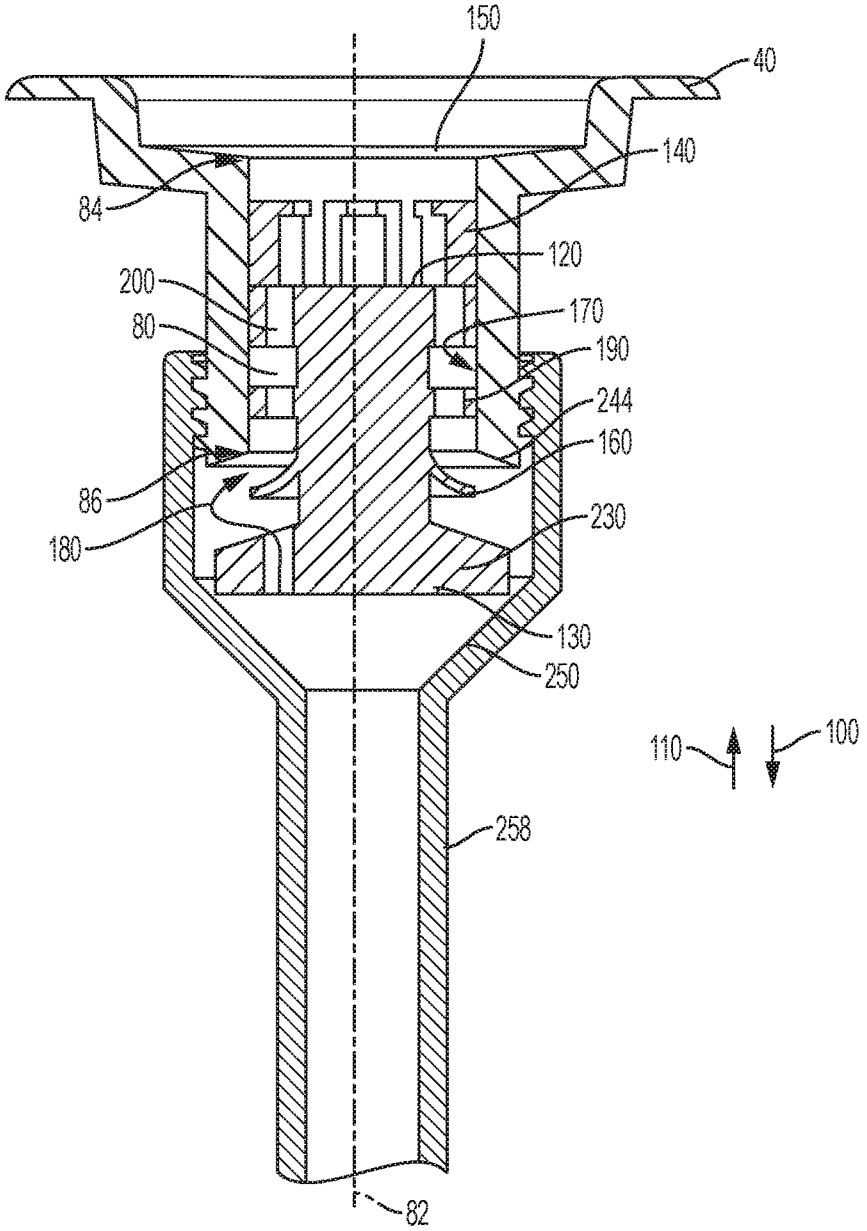
FIG. 9 is a sectional view of the closed loop connector of FIG. 8 shown in the open position shown with the hollow tube engaging with the outer cap.

As best seen in FIG. 7, in some cases, each crown element comprises a tapered outer surface 144. The tapered outer surface 144 facilitates the sliding motion of the crown elements 140 into the first passage 80 when the crown elements 140 retract radially inwardly. Additionally, each crown element comprises one or more upright edges 148. The upright edges 148 rest against a planar surface 150 of the outer cap 40 thereby preventing the crown elements 140 from retracting radially inwardly once the plug 60 is locked in its closed position. The plug 60 can slide from the first end 84 of the first passage 80 and into the first passage 80 when the crown elements 140 are in a retracted position (e.g., as shown in FIGS. 8 and 9). The crown elements 140 can be made of a flexible material (e.g., in comparison to the outer cap 40), or be spring-biased toward the extended state. Such embodiments allow the crown elements 140 to extend (e.g., due to their flexibility or spring action) from their retracted state automatically when proximal to the planar surface 150 of the outer cap 40. In some cases, the crown elements 140 can matingly engage with a dispensing probe (not shown). In such cases, the tapered outer surface 144 can form a frictional fit with the dispensing probe. Alternatively, the crown elements 140 can have a non-tapering surface (e.g., as shown in FIGS. 8 and 9) that forms a frictional fit with the dispensing probe.

With continued reference to FIGS. 6 and 7, the connector includes a first flap 160 positioned on the plug 60. The connector can include additional flaps 160 spaced apart from the first flap 160. For instance, in the embodiments illustrated in FIGS. 6 and 7, the connector comprises three flaps 160. More or fewer flaps 160 are contemplated within the scope of the invention. As best seen in FIG. 6, the first flap 160 abuts against the first passage 80 of the outer cap 40. The first flap 160 can abut against an interior surface 170 of the first passage 80 to block the fluid from the container 20 to the dispensing probe from flowing past the first flap 160. For instance, if the plug 60 is locked in the closed position, any fluid dispensed (e.g., by venturi action, pouring or pumping the fluid from the container 20) may enter the first passage 80 and contact one or more flaps 160. As the flaps 160 abut against the interior surface 170 of the first passage 80, they form a barrier and prevent fluid to flow in the first passage 80 past the flaps 160.

FIGS. 8 and 9 illustrate the connector with the plug 60 in an open position with and without a hollow tube 70 respectively. When the plug 60 is unlocked from its closed position and moves to the open position, the first surface 120 of the plug 60 slides away from the first end 84 of the first passage 80 along the first direction 100. In the open position, the first flap 160 can be configured such that it is positioned below the second end 86 of the first passage 80 when the container 20 is upright, as shown in the embodiments illustrated herein. If the container 20 shown in FIG. 1 were to be inverted by 180 degrees, in the open position, the first flap 160 can be above the second end 86 of the first passage 80. In both the upright and inverted position of the container 20, in the open position, the first flaps 160 do not contact the interior surface 170 of the first passage 80, thereby permitting fluids to pass through the first passage 80 and toward the dispensing probe connected to the outer cap 40 at the first end 84 of the first passage 80. For instance, when the plug 60 is in the open position, the position of the first flap 160 below the second end 86 of the first passage 80 can create a second passage 180 for the fluid from the container 20 toward the dispensing probe.

The flaps 160 can be made of materials such as low density resin polymer. The flaps 160 can be manufactured to tight tolerances, such that the flaps 160 abut against the interior surface 170 of the first passage 80 without leaving an annular gap therebetween in the closed position of the plug 60. In some cases, the flaps 160 can be substantially flexible relative to the body of the plug 60. In such cases, and with continued reference to FIGS. 8 and 9, the connector comprises at least one guidance ring 190 that can align the first flap 160 along a radial direction. Moreover, the guidance ring 190 can align the first flap 160 along the longitudinal axis 82 of the first passage 80. Additionally, the connector can include more than one guidance ring 190 positioned on the plug 60 and spaced apart from each other along the longitudinal axis 82 of the first passage 80. Each flap can be positioned proximal to a guidance ring 190 along the longitudinal axis 82 of the first passage 80. As will be described below, the guidance rings 190 can be configured such that they guide in positioning the flap in place without blocking the flow of fluids from the container 20 toward the dispensing probe.

Referring back to FIG. 7, the plug 60 can have a plurality of apertures 200 positioned thereon at a first radial distance 210 at the first surface 120. Correspondingly, the guidance ring 190 can include apertures 200 positioned at the first radial distance 210. The apertures 200 can extend through each guidance ring 190 and thereby define a third passage 220 (shown in FIG. 9, by the arrow "220") in fluid communication with the first passage 80. The third passage 220 facilitates flow of fluid from the container 20 to the dispensing probe when the plug 60 is unlocked. The apertures 200 on the guidance ring 190 additionally ensure that the guidance ring 190 do not create any additional resistance or blockage to the flow of fluids from the container 20. The apertures 200 on the first surface 120 of the plug 60 can be in line with the apertures 200 on each guidance ring 190, such that fluid from the first passage 80 can enter the third passage 220 defined in the guidance ring 190. Referring back to FIG. 6, the fluid can leave the third passage 220, and via the first passage 80 (e.g., gap between the guidance ring 190 and a second surface 130 of the plug 60), enter the apertures 200 defined on the plug 60. The apertures 200 of the plug 60 extend between the first and second surface 130, thereby allowing the fluid to finally leave the plug 60 via the first surface 120. The dispensing probe can be in fluid communication with the first surface 120 of the plug 60 (e.g., due to a frictional fit between the crown elements 140 and the dispensing probe), and because of a pressure difference generated in the dispensing probe (e.g., vacuum), the fluid can be drawn into the dispensing probe for dispensing to a target (e.g., another container 20, a user, a surface such as a floor, etc.).

With continued reference to FIGS. 6 and 7, in some cases, the plug 60 can have a distal flange 230 positioned proximal to the second end 86. The distal flange 230 can be integrally formed with the plug 60. The distal flange 230 can have a cross-sectional area greater than that of the first passage 80 to prevent the plug 60 from sliding out of the first passage 80. In such cases, the first passage 80 has a generally constant cross-sectional area along the longitudinal axis 82, such that the distal flange 230 is prevented from sliding into the first passage 80 due to the differences in cross-sectional areas between the first passage 80 and the distal flange 230. In turn, the distal flange 230 can act as a stopper and prevent further movement of the plug 60 along the second direction 110 so that when the dispensing probe is disengaged from the connector, the plug 60 does not continue to slide out of the first passage 80. The distal flange 230 can be shaped and oriented such that the distal flange 230 rests proximal to the second end 86 of the first passage 80 over a contact surface 240 when the plug 60 is locked in the closed position (e.g., by extended crown elements 140), as shown in FIG. 6. In such cases, once the upright edge 148 of each crown element rests against the planar surface 150 of the outer cap 40, the contact surface 240 of the distal flange 230 contacts an edge 244 proximal to the second end 86, thereby preventing further sliding movement of the plug 60 along the second direction 110. As seen in FIGS. 6 and 7, the contact surface 240 of the distal flange 230 can be generally tapered to facilitate contact against the interior surface 170 of the first passage 80 at a predetermined distance from the first end 84 of the first passage 80. Correspondingly, the first passage 80 can have a chamfered edge 244 proximal to the second end 86 to facilitate better contact with the contact surface 240 of the distal flange 230. As seen in FIGS. 6 and 7, the distal flange 230 can have apertures 200 positioned at the first radial distance 210, and in line with the apertures 200 of the plug 60 and the guidance rings 190. The distal flange 230 can also have fewer apertures 200 than the guidance rings 190.

As described previously, the plug 60 may be movable between an open and a closed position by engaging and disengaging a dispensing probe. Once open, the plug 60 slides into the first passage 80. In such cases, as illustrated in FIGS. 6 and 9, the connector has a tube 70 matingly coupled to the plug 60 at the second surface 130 of the plug 60 to prevent the plug 60 from sliding past the second end 86 of the first passage 80 and into the container 20 when unlocked. At least a portion of the tube 70 can have a cross-sectional area less than the cross-sectional area of at least a portion of the plug 60. For instance, a first portion 250 of the tube 70 can have a cross-sectional area less than a cross-sectional area of the distal flange 230 (e.g., cross-section of the second surface 130 of the plug 60 or the contact surface 240 as shown in FIGS. 6 and 9). In this case, the tube 70 can receive the plug 60 over the first portion 250 of the tube 70 when the plug 60 slides past the second end 86 of the first passage 80 when unlocked, but prevent further passage of the plug 60 into the container 20 once a portion of the distal flange 230 (e.g., the second surface 130 or the contact surface 240) abuts against an interior surface 254 of the tube 70. Additionally, as shown in FIG. 9, a second portion 258 of the tube 70 can have a cross-sectional area less than the cross-sectional area of the plug 60. Such an embodiment prevents the plug 60 from sliding past the first portion 250 of the tube 70. As shown in FIG. 6, the tube 70 can be threadingly coupled to the outer cap 40. The interior surface 170 of the tube 70 can have threads defined thereon that can engage with threads defined on an exterior surface of the outer cap 40. Other connection means (e.g., ribs 50, as shown in FIG. 9, or other friction fit or snap-on connection means or welded connection) are also contemplated. The tube 70 also has connecting members 260 (e.g., hose barbs as shown in FIGS. 4A-4B or other leak-proof fittings) to connect to a hose, which can be in fluid communication with the fluids in the container 20 and can suction fluids thereof.

Figure 10A:
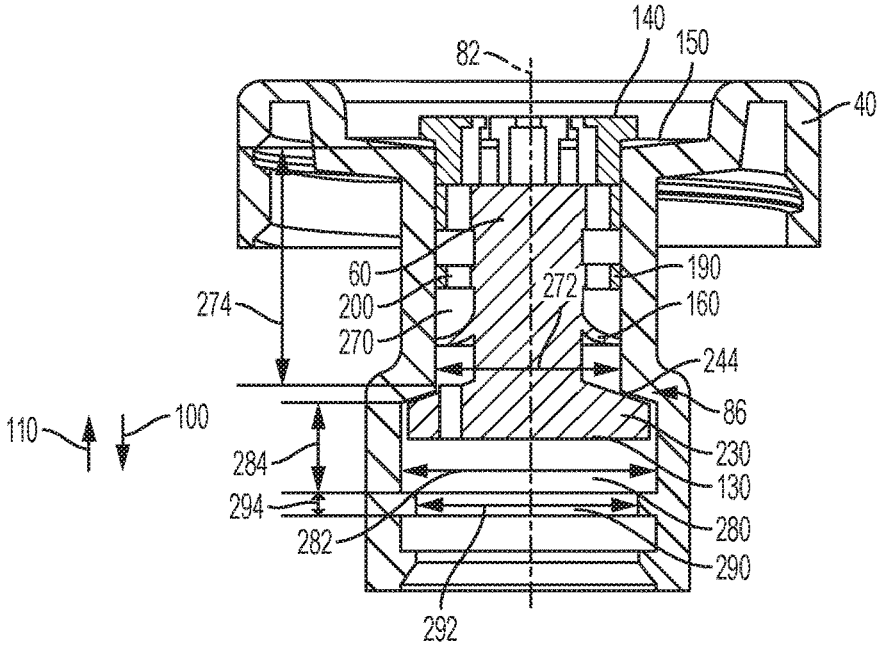
FIG. 10A is a sectional view of a closed loop connector shown according to a third embodiment with the plug in a closed position.
Figure 10B:
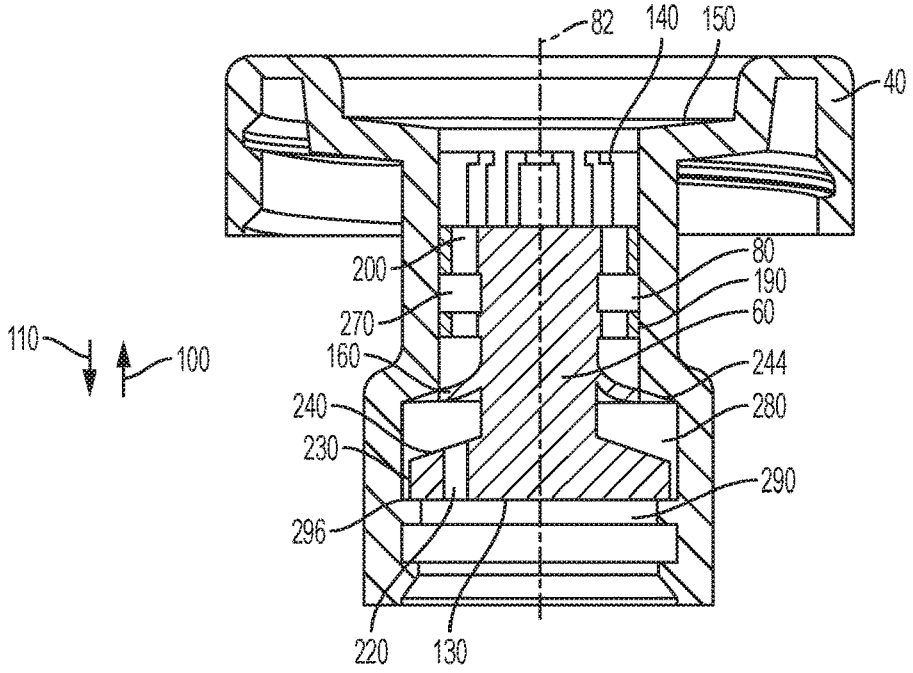
FIG. 10B is a sectional view of the closed loop connector shown in FIG. 10A with the plug in an open position.

FIGS. 10A and 10B illustrate a connector according to another embodiment in the closed and open positions respectively. In this case, the outer cap 40 engages with the container 20 (e.g., by threaded connection, ribs, welded connection, or friction fit as described previously) as described previously for the other embodiments. In the illustrated embodiment shown in FIGS. 10A and 10B, however, the connector does not include a tube 70 for catching the plug 60 when the plug 60 is unlocked. Alternatively, as illustrated in FIGS. 10A and 10B, the first passage 80 can have a variable cross-sectional area along the longitudinal axis 82 of the first passage 80. For instance, the first passage 80 has a first region 270 having a first cross-sectional area 272 over a first distance 274 of the first passage 80, a second region 280 having a second cross-sectional area 282 over a second distance 284 of the first passage 80 and a third region 290 having a third cross-sectional area 292 over a third distance 294 of the first passage 80. The first cross-sectional area 272 is less than the cross-sectional area of at least a portion of the distal flange 230 of the plug 60 (e.g., contact surface 240 of the plug 60), but is sufficiently large to allow the plug 60 to slidingly engage with the first passage 80 over the first distance 274 of the first passage 80, such that the flaps 160 of the plug 60 abut against an interior surface 170 of the first passage 80 in the first region 270. The second cross-sectional area 282 can be sufficiently large to allow the distal flange 230 to slide in the second region 280. The third cross-sectional area 292 can be less than the cross-sectional area of the distal flange 230 such that the distal flange 230 is prevented from sliding past the second region 280 and into the third region 290 of the first passage 80. The second region 280 can be positioned in between the first and third region 290 in upright, inverted, slanted or sideways (lateral) orientation of the container 20.

With continued reference to FIGS. 10A and 10B, during use, when the plug 60 is drawn past the first end 84 of the first passage 80 to lock it in the closed position along the second direction 110 (e.g., due to removing a dispensing probe or due to difference in pressure acting on the first and second surface 130 of the plug 60), the contact surface 240 of the distal flange 230 abuts against an edge 244 proximal to the second end 86 of the first passage 80. The first cross-sectional area 272 is less than the cross-sectional area of the distal flange 230, which prevents further sliding motion of the plug 60 from out of the first passage 80. The variable cross-sectional area of the first passage 80 can therefore prevent the plug 60 from being disengaged with the outer cap 40 when the plug 60 is locked in the closed position. In the open position, when the plug 60 is pushed into the first passage 80 along the first direction 100 (e.g., by engaging the dispensing probe, and because of difference in pressure acting on the first and second surface 130 of the plug 60), the distal flange 230 slides in the second region 280. Correspondingly, the flap creates the second passage 180 to allow fluid from the container 20 to flow out of the connector. The distal flange 230 continues to slide in the second region 280 until the second surface 130 abuts against an edge 296 proximal to the third region 290 and is prevented from further sliding into the first passage 80, thereby catching the plug 60 when it is in the open position.

Figure 11A:
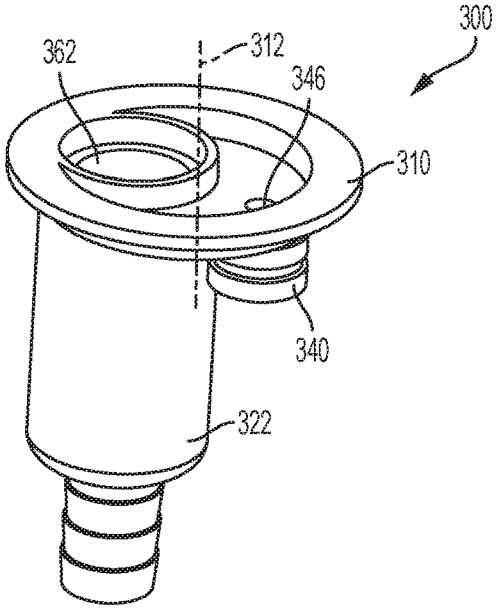
FIG. 11A is a perspective view of a closed loop connector according to a fourth embodiment.
Figure 11B:
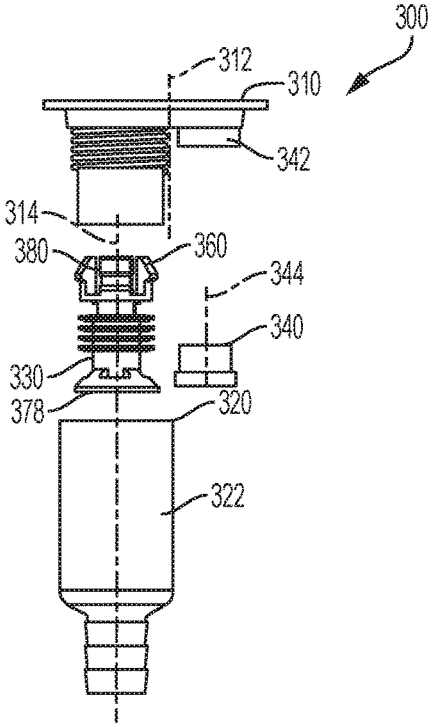
FIG. 11B is an exploded front view of the closed loop connector shown in FIG. 11A.

FIGS. 11A-11B illustrate a closed loop connector 300 according to another embodiment. The embodiments illustrated in FIGS. 11A-11B are similar to those shown in FIGS. 4A-10B except for the differences noted below. In the embodiment shown in FIGS. 11A-11B, the outer cap 310 is centrally disposed about a central axis 312 offset from the longitudinal axis 314 of the first passage 320 defined in the hollow tube 322. As shown in FIG. 11B, the outer cap 310 has a threaded connection with the hollow tube 322, although other connections such as snap on, push fit, barbed fittings and the like can be used. While the plug 330 is coaxial with the first passage 320, the plug 330 is offset from the central axis 312 of the outer cap 310. In such cases, the space created on the outer cap 310 due to the offset location of the plug 330 can be used to provide a membrane vent 340 molded to the bottom surface 342 (directed toward the fluid in the fluid container 350) of the outer cap 310. The membrane vent 340 comprises a central axis 344 that is offset from central axis 312 of the outer cap 310. The membrane vent 340 can permit off-gasing of fluids stored in the fluid container 350 via an aperture 346 on the outer cap 340, while also permitting better wicking of the fluids that may reach the top of the fluid container 350. Such embodiments can be beneficial in permitting the fluids in the fluid container 350 to off-gas while generally sealing the fluid container 350 to reduce any leakage of fluids.

Figure 12A:
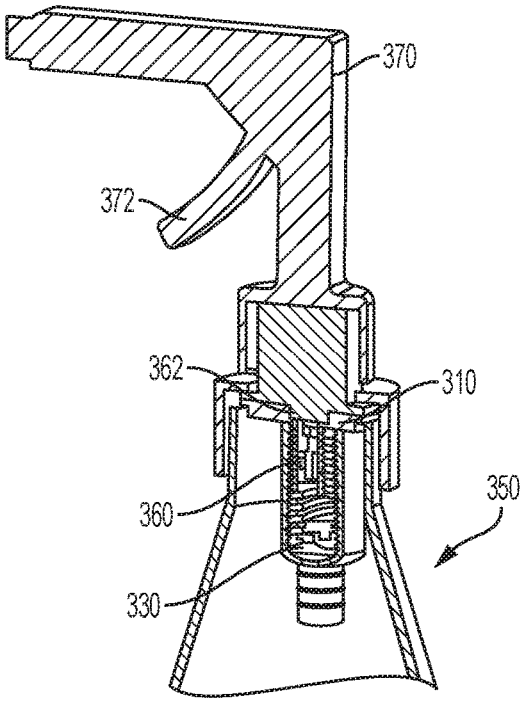
FIG. 12A is a cross-sectional view of a fluid container with a dispensing probe according to another embodiment, with the closed loop connector shown in the open position.
Figure 12B:
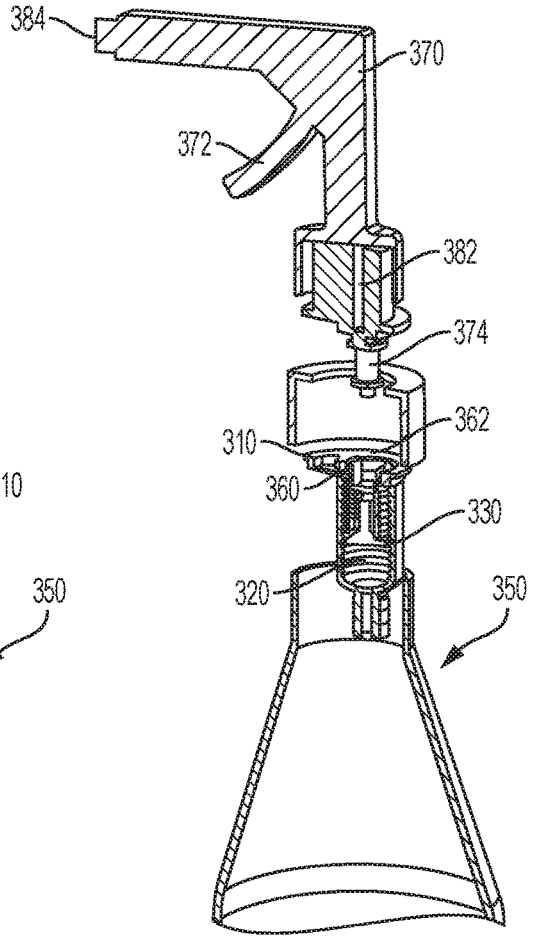
FIG. 12B is an exploded cross-sectional view of the fluid container shown in FIG. 12A with the closed loop connector shown in the closed position.

FIG. 12A is a cross-sectional perspective view of a fluid container 350 with the connector 300 shown in the open position and FIG. 12B is a cross-sectional exploded perspective view of the fluid container 350 with the connector 300 shown in the closed position. In FIG. 12A, the plug 330 has slid into the first passage 320 such that fluids may flow through the first passage 320 and out of the fluid container 350. In FIG. 12B, the crown elements 360 have extended radially outwardly and the plug 330 is at the first end 362, and fluids are prevented from leaving the fluid container 350.

As was mentioned previously with respect to FIGS. 3A-3B, the outer cap 40 is connected to a dispensing probe 22 to draw fluids by generating suction. Referring now to FIGS. 12A-12B, the dispensing probe, according to some embodiments can be a spray trigger 370. The spray trigger 370 can be coupled to the outer cap 310, and as is generally known in the art, comprises a spray handle 372 and a pump (not shown) that can be actuated to draw fluids out of the fluid container 350. While the illustrated embodiment show the spray trigger 370 coupled to the connector 300 shown in FIGS. 11A-11B, as is apparent to one skilled in the art, the spray trigger 370 may alternatively be coupled to any of the embodiments of the connectors illustrated in FIGS. 4A-10B.

Referring now to FIG. 12B, the spray trigger 370 comprises a stem 374 that engages with the plug 330 using means known in the art (e.g., barb fittings or other fluid connectors). In the embodiment shown in FIGS. 12A and 12B, the stem 374 is offset from the central axis 312 of the cap so as to matingly engage with the plug 330. Once engaged, the stem 374 is generally surrounded by the crown elements 360 of the connector 300. In such cases, engaging the spray trigger 370 to the outer cap 310 may lead to the crown elements 360 retracting radially inwardly (e.g., toward the longitudinal axis 314). When engaged, the pressure acting on the first surface 378 of the plug 330 may be different from a pressure acting on the second surface 380 of the plug 330, such that the plug 330 slides into the first passage 320. Further, when the spray trigger 370 is disengaged, the plug 330 can move upward toward the first end 362 because of any pressure difference that may occur between the first surface 378 and the second surface 380 of the plug 330 when the spray trigger 370 is removed. Once the plug 330 slides toward the first end 362, the crown elements 360 can retract radially outward to return to the closed position whereby fluid in the fluid container 350 is prevented from passing through the connector 300.

As shown in FIG. 12B, the spray trigger 370 comprises a flow passage 382 defined on the stem 374. The flow passage 382 is fluidly coupled to the first passage 320 of the connector 300. The fluid enters the first passage 320, passes through the flow passage 382 and is dispensed out of a flow outlet 384 of the spray trigger 370 when suction is being generated in the flow passage 382 of the spray trigger 370. For instance, the spray trigger 370 can be actuated when the plug 330 is in the open position, by manipulating the spray handle 372. The pump (not shown) of the spray trigger 370 generates a suction force in the flow passage 382 such that the fluid leaving the first passage 320 (e.g., around the flaps 390, through the first passage 320 and out of the apertures as described previously), and enter the flow passage 382 of the spray trigger 370, and flow out of a flow outlet 384 (e.g., a nozzle). In some such cases, the fluid can be atomized such that it is dispensed as a spray, rather than as a continuous stream of fluid. Such embodiments can be useful as reusable and recyclable fluid containers.

Figure 13A:
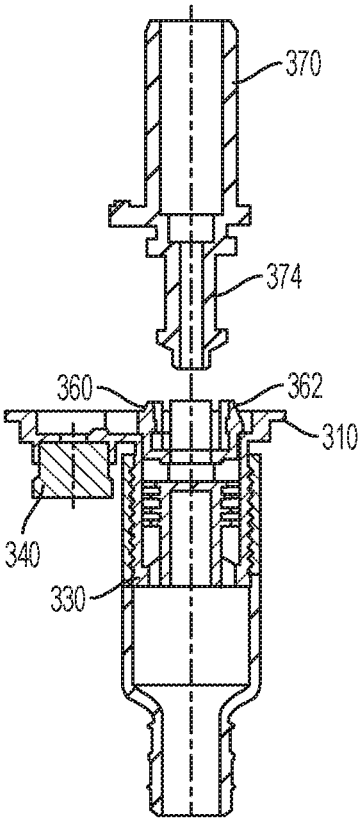
FIG. 13A is a cross-sectional front view of a portion of the fluid container shown in FIG. 12A that illustrates the details of the connector and the spray trigger in the closed position.
Figure 13B:
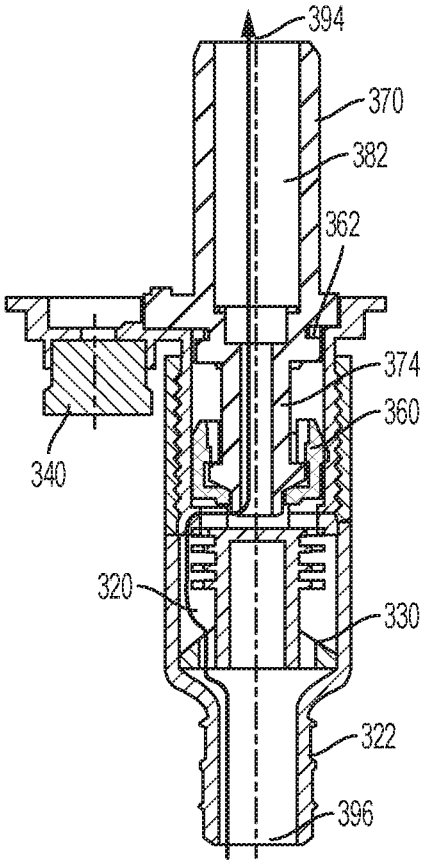
FIG. 13B is a cross-sectional front view of a portion of the fluid container shown in FIG. 12A that illustrates the details of the connector and the spray trigger in the open position.
Figure 14:
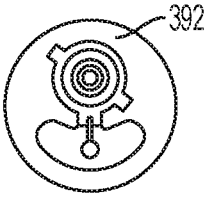
FIG. 14 is an exemplary embodiment of a membrane seal according to an embodiment.

FIGS. 13A and 13B are cross-sectional front views of the connector 300 and the spray trigger 370 shown in FIGS. 12A and 12B. In FIG. 13A, the connector 300 is illustrated in the closed position, while in FIG. 13B, the connector 300 is illustrated in the open position. Referring to FIG. 13A, the crown elements 360 of the plug 330 are proximal to the first end 362 and have extended radially outwardly relative to their position in FIG. 13B. The flaps 390 of the plug 330 seal the first passage 320, such that liquids do not escape through the first passage 320 and out of the container. Preferably, in some cases, a membrane seal can be placed between the outer cap 310 and the plug 330 to further reduce any leakage that may occur. One such example of a membrane seal 392 is shown in FIG. 14. In some cases, the membrane seal 392 can be color coded or have other visual aids to allow a user to select a suitable connector 300 for use with a particular type of fluid container 350 or a particular type of dispensing probe. Further, the membrane seal 392 can be of a complementary shape to the plug 330 and the outer cap 310 such that to provide mating connection therewith, such that a user may select an appropriate connector that matches with the shape of the outer cap.

Referring back to FIG. 13B, the stem 374 of the spray trigger 370 has engaged with the plug 330, and the crown elements 360 are in contact with the outer walls of the stem 374. A portion of the stem 374 extends into the first passage 320 as the plug 330 moves away from the first end 362 and into the first passage 320. In this configuration, fluid flows out along the arrow 394 by passing through openings near the first surface 378 of the plug 330, around the flaps 390 and enter the flow passage 382 of the spray trigger 370, outwardly toward the flow outlet 384 (now shown in FIG. 13B). In this configuration, the tube 322 and plug 330 are of a complementary shape such that the plug 330 is prevented from falling out of distal end 396 of the tube 322 and into the container (not shown in FIG. 13B).

In use, a user can typically secure the connector on the outer cap 40 (as described above with respect to any of the embodiments disclosed herein). The user can unlock the plug 60 to dispense fluids from the container 20. The crown elements 140 of the plug 60 retract radially inwardly and into the first passage 80. When fluid is being dispensed, the flaps 160 do not abut against the interior surface 170 of the first passage 80 and allow fluid to flow out of the container 20. The user can then stop the dispensing operation, and the plug 60 can slide out of the first passage 80 and be locked securely by extending the crown elements 140 radially outward. Once locked, the user does not come into contact with the fluid.

Embodiments disclosed herein have one or more advantages. Closed loop connectors such as those described herein can protect the user from inadvertently being exposed to fluids (e.g., chemicals, corrosive reagents and the like) present in the container, thereby offering safe dispensing operation. The connector can be made with recyclable materials and not have any metal components or non-recyclable parts, thereby allowing a user to easily rinse and recycle the container and the connector. Such connectors are also of a universal design, allowing users to easily be connected to containers of different shapes, sizes, and for different applications.

Thus, embodiments of a closed loop connector are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention.

What is claimed is:

1. A connector for selectively dispensing fluid from a container via a dispensing probe, the connector comprising:

an outer cap supported by a container opening, the outer cap having a first passage, the first passage having a longitudinal axis, a first end, and a second end, the first and second ends being separated by a length along the longitudinal axis;

a plug being slidingly movable in the first passage between an open position and a closed position, the plug having a first end and a second surface; and a plurality of crown elements positioned at a first surface of the plug, the plurality of crown elements adapted to lock the plug proximal to the first end of the first passage in the closed position, and the plurality of crown elements allowing the plug to slide from the first end into the first passage and to unlock the plug into the open position, the plug preventing a flow of fluid from the container to the dispensing probe when locked in the closed position, and the plug allowing the flow of fluid from the container to the dispensing probe when unlocked into the open position.

2. The connector of claim 1, further comprising a first flap positioned on the plug, the first flap forming a frictional fit with the first passage when locked in the closed position.

3. The connector of claim 2, wherein the first flap is adapted to abut against an interior surface of the first passage to block the fluid from the container to the dispensing probe from flowing past the first flap in the closed position.

4. The connector of claim 3, wherein the first flap of the first passage does not abut against the interior surface of the first passage when the plug is unlocked, the position of the first flap when the plug is unlocked creating a second passage for the fluid from the container toward the dispensing probe.

5. The connector of claim 2, further comprising at least one guidance ring adapted to align the first flap along a radial direction.

6. The connector of claim 5, wherein the guidance ring is further adapted to align the first flap along the longitudinal axis of the first passage.

7. The connector of claim 5, further comprising a plurality of guidance rings positioned on the plug and spaced apart from each other along the longitudinal axis of the first passage.

8. The connector of claim 7, further comprising two or more flaps positioned on the plug and spaced apart from the first flap along the longitudinal axis of the first passage, each flap being positioned proximal to a guidance ring along the longitudinal axis of the first passage.

9. The connector of claim 5, further comprising a plurality of apertures positioned on the plug at a first radial distance, the plurality of apertures extending through each guidance ring defining a third passage, the flow of fluid from the container to the dispensing probe passing through the third passage and the plurality of apertures, when the plug is unlocked.

10. The connector of claim 9, wherein each crown element of the plurality of crown elements comprises a tapered outer surface, the tapered outer surface adapted to form a frictional fit with the dispensing probe, the tapered outer surface adapted to allow the plurality of crown elements to slide along the first passage when the plurality of crown elements retract radially inwardly.

11. The connector of claim 10, wherein each crown element comprises one or more upright edges adapted to rest against a surface of the outer cap, thereby preventing the plurality of crown elements from retracting radially inwardly.

12. The connector of claim 1, wherein each crown element matingly engages with the dispensing probe.

13. The connector of claim 1, wherein the first passage has a constant cross-sectional area along the longitudinal axis of the first passage.

14. The connector of claim 1, wherein the first passage has a variable cross-sectional area along the longitudinal axis of the first passage.

15. The connector of claim 14, further comprising a distal flange positioned at the second surface of the plug, the distal flange having a cross-sectional area greater than a cross-sectional area of the plug.

16. The connector of claim 15, wherein the first passage has a cross-sectional area at the second end less than a cross-sectional area of the distal flange, a contact surface of the distal flange abutting against an interior surface of the first passage proximal to the second end of the first passage, thereby preventing the plug from sliding out of the first passage past the first end of the first passage such that the plug is prevented from being disengaged with the outer cap when locked in the closed position.

17. The connector of claim 1, further comprising a tube matingly coupled to the plug, the tube adapted to prevent the plug from sliding past the second end of the first passage when unlocked.

18. The connector of claim 17, wherein the tube is threadingly coupled to the outer cap, the tube adapted to receiving the plug over a first portion of the tube when the plug slides past the second end of the first passage when unlocked, the tube having a cross-sectional area less than the cross-sectional area of the plug over a second portion of the tube such that the plug is prevented from sliding past the first portion of the tube.

19. A connector for selectively dispensing fluid from a container via a dispensing probe, the connector comprising:

an outer cap supported by a container opening, the outer cap having a first passage and a central axis, the first passage having a longitudinal axis offset from the central axis;

a plug positioned so as to be coaxial with the longitudinal axis of the first passage, the plug being slidingly movable in the first passage between an open position and a closed position, the plug preventing a flow of fluid from the container to the dispensing probe when locked in the closed position, and the plug allowing the flow of fluid from the container to the dispensing probe when unlocked into the open position; and a plurality of crown elements positioned at a first surface of the plug, the plurality of crown elements being extendable to lock the plug into the closed position, and the plurality of crown elements being retractable to unlock the plug into the open position.

20. The connector of claim 19, wherein the outer cap comprises a vent disposed thereon, the vent permitting off-gasing of a fluid stored in the container.

21. The connector of claim 19, further comprising a membrane vent attached to the outer cap, the membrane vent permitting off-gasing of a fluid stored in the container and permits wicking of the fluid stored in the container.

22. The connector of claim 21, wherein the membrane vent is attached to a bottom surface of the outer cap, the bottom surface of the outer cap being directed toward the fluid stored in the container.

23. The connector of claim 21, wherein the membrane vent is disposed about the central axis, the central axis of the membrane vent being offset from the longitudinal axis of the first passage.

24. The connector of claim 19, wherein the dispensing probe is a spray trigger coupled to the outer cap, the spray trigger comprising a flow passage and a flow outlet, the flow passage being fluidly coupled to the first passage such that fluid from the container enters the first passage, passes through the flow passage and is dispensed out of the flow outlet of the spray trigger.

25. The connector of claim 24, wherein the dispensing probe comprises a stem, the flow passage being at least partially housed in the stem of the spray trigger.

26. The connector of claim 25, wherein the stem is receivable by the plug, such that when received, the stem is generally surrounded by the plurality of crown elements.

27. A closed loop dispensing system, comprising:

a container comprising fluids dispensable out of the container, the container having a container opening; and a connector for selectively dispensing the fluids from the container, the connector comprising:

an outer cap sealingly connected to the container opening, the outer cap having a first passage, and a central axis, the first passage having a longitudinal axis offset from the central axis, a plug positioned so as to be coaxial with the longitudinal axis of the first passage, the plug being slidingly movable in the first passage between an open position and a closed position, the plug preventing a flow of fluid from the container when locked in the closed position, and the plug allowing the flow of fluid from the container when unlocked into the open position, and a plurality of crown elements positioned at a first surface of the plug, the plurality of crown elements being extendable to lock the plug into the closed position, and the plurality of crown elements being retractable to unlock the plug into the open position.

* * * * *